US005707266A

United States Patent [19]

Arena

[11] Patent Number: 5,707,266

[45] Date of Patent: Jan. 13, 1998

[54] SWIMMING/PADDLING AID

[75] Inventor: Joseph Arena, 159 Copacabana Drive, Copacabana, New South Wales, 2251, Australia

[73] Assignees: Joseph Arena; Barry Raymond Ross, both of New South Wales, Australia

[21] Appl. No.: 569,230

[22] PCT Filed: Jun. 7, 1994

[86] PCT No.: PCT/AU94/00306

§ 371 Date: Jun. 19, 1996

§ 102(e) Date: Jun. 19, 1996

[87] PCT Pub. No.: WO95/03095

PCT Pub. Date: Feb. 2, 1995

[30] Foreign Application Priority Data

Jul. 20, 1993 [AU] Australia ..... PM0040

[51] Int. Cl.[6] ..... A63B 31/12

[52] U.S. Cl. ..... 441/59

[58] Field of Search ..... 441/55–61

[56] References Cited

U.S. PATENT DOCUMENTS

| | | | |
|---|---|---|---|
| 1,545,807 | 7/1925 | Ajello . | |
| 1,622,914 | 3/1927 | Kindt . | |
| 1,695,125 | 12/1928 | Rensing . | |
| 2,771,618 | 11/1956 | Crum | 441/59 |
| 3,107,371 | 10/1963 | Thompson | 441/59 |
| 3,286,287 | 11/1966 | Martin | 441/57 |
| 4,040,136 | 8/1977 | Garcia | 441/59 |
| 4,756,699 | 7/1988 | Brom . | |

FOREIGN PATENT DOCUMENTS

| | | | |
|---|---|---|---|
| 1391148 | 1/1965 | France | 441/55 |
| 428851 | 7/1924 | Germany . | |
| 2454686 | 5/1976 | Germany . | |
| 2917246 | 11/1980 | Germany . | |
| 2014048 | 8/1979 | United Kingdom . | |
| 2055587 | 3/1981 | United Kingdom . | |
| 86555/91 | 6/1992 | WIPO . | |

*Primary Examiner*—Stephen Avila

*Attorney, Agent, or Firm*—Ladas & Parry

[57] ABSTRACT

A device to aid in paddling through or upon water. The device comprises a flexible cover, at least one flexible flap and an insert located in each flap.

15 Claims, 3 Drawing Sheets

SWIMMING/PADDLING AID

FIELD OF THE INVENTION

The following invention relates to a device to aid a swimmer or surfer for example in a swimming or paddling action through or upon water.

When swimming or surfing, or otherwise moving through or upon water using the paddling action of ones arms, the available thrust is limited to the extent to which the swimmer or surfer may cup his or her hand to displace the water. Another limiting factor is the projected area of the swimmer's forearm which also passes through the water during a paddling action.

It would be desirable to provide a means of increasing the projected area of a swimmer's forearm when viewed in a direction of movement of the forearm through the water during paddling. It would also be desirable to limit the projected area of the forearm when the arm is moved in the opposite direction through the water.

DISCLOSURE OF THE INVENTION

There is disclosed herein a device for wearing by a swimmer, surfer or other person to aid in paddling through or upon water, said device comprising:

a flexible cover to be worn about a limb of the person, and at least one flap extending outwardly from said flexible cover and adapted to open upon movement of the person's limb substantially in a first predetermined direction through the water, and to essentially close upon movement in a direction substantially opposite to said first mentioned direction.

Preferably, two such flaps are provided, each at mutually opposite lateral locations of the flexible cover.

Preferably, each flap is attached to the flexible cover to form a cup shape therewith.

Preferably, the flaps are stitched to the flexible cover.

Preferably, the flexible cover has an opening at one end which is substantially smaller than an opening at the other end.

Preferably, the flexible cover comprises a zipper or other fastening means extending from the end having said smaller opening toward the other end.

Preferably, the zipper or other fastening means reaches the other end.

Preferably, inserts are located in each flap, which inserts are more rigid than the material from which the cover and flaps are formed.

Preferably, the flexible cover is formed of neoprene or any other suitably flexible and elastic material.

Preferably, the flap(s) is/are formed from a substantially inextensible, though flexible material, typically nylon sheeting.

Preferably, the device further comprises a pair of substantially inextensible bands, each located about the openings at said one and other ends.

In an alternative form of the invention, the flexible cover may simply be part of the sleeve of a wet suit.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 2B:
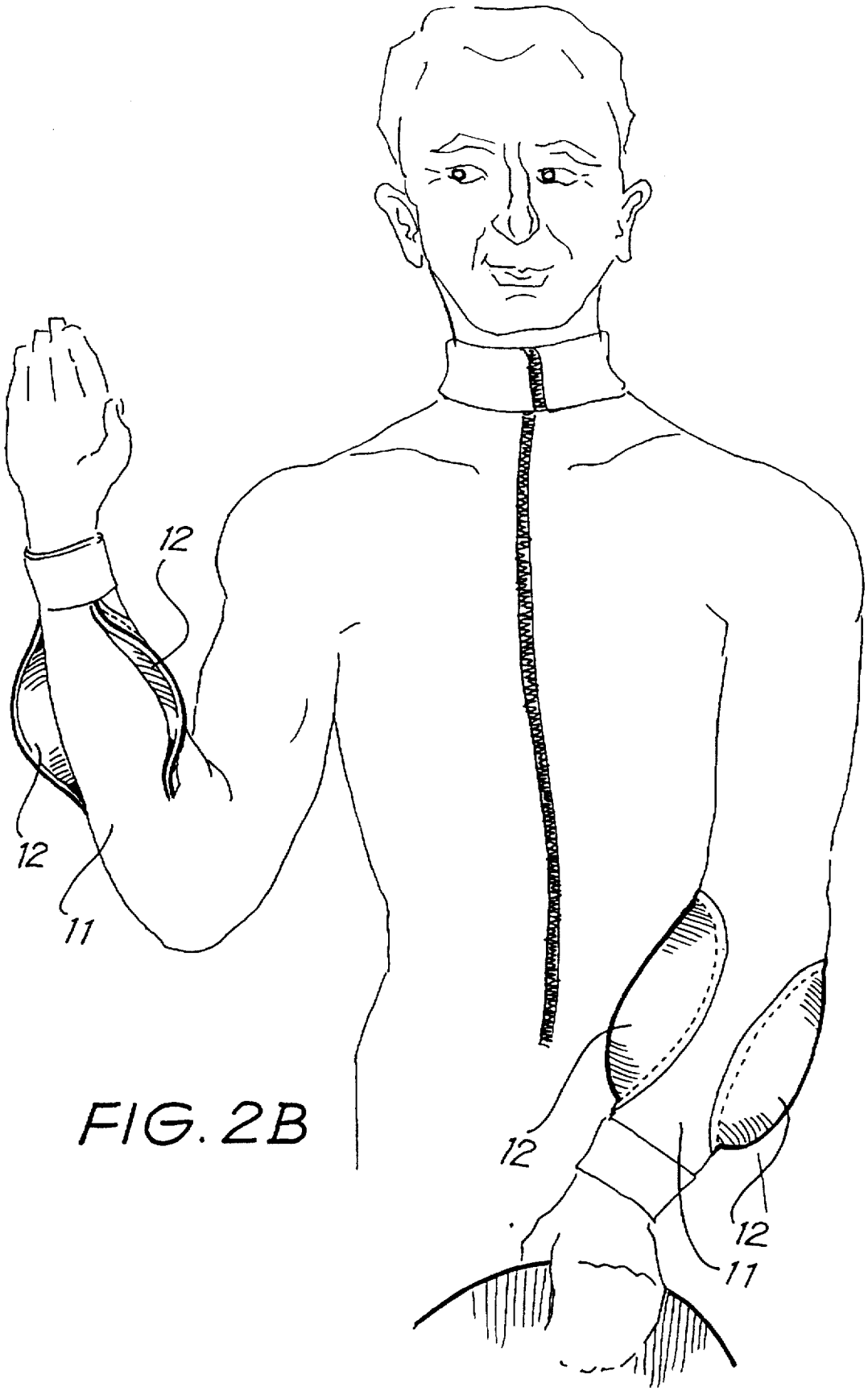
FIG. 2B is a schematic perspective view of a surfer wearing a long sleeved wet suit, the sleeves of which each have a pair of flaps attached thereto in the region of the surfer's forearms.

In the accompanying drawings there is schematically depicted a swimming/paddling aid 10 which comprises a flexible cover 11, typically formed of neoprene rubber and to be worn about the forearm of a surfer, swimmer or any one who might like to paddle through water. The flexible cover 11 might alternatively be the sleeve of a wet suit as for example shown in FIG. 2B.

Stitched to or otherwise adhered to the flexible cover 11 is a pair of laterally opposed flaps 12, also formed of flexible material such as neoprene rubber or thinner nylon fabric or the like. The stitching indicated by 13 in the drawings.

It should be appreciated that one end of the cover 11 has an opening 16 of a size to fit around the wrist of a user, whereas the opening 15 at the opposite end of cover 11 is substantially larger. To enable the user to pass his or her hand through the opening 16, a zipper 14 is provided in the cover 11 which may be opened for applying or removing the device 10. Alternatively, a Velcro™ strip, laces, press studs, buttons, buckles or any other openable/closable means may be adopted.

Figure 3A:
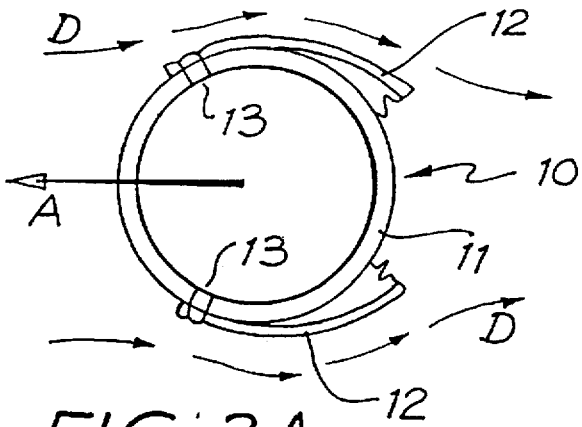
FIG. 3A is a schematic end elevational view of a paddling aid having closed flaps during movement in one direction through water.
Figure 3B:
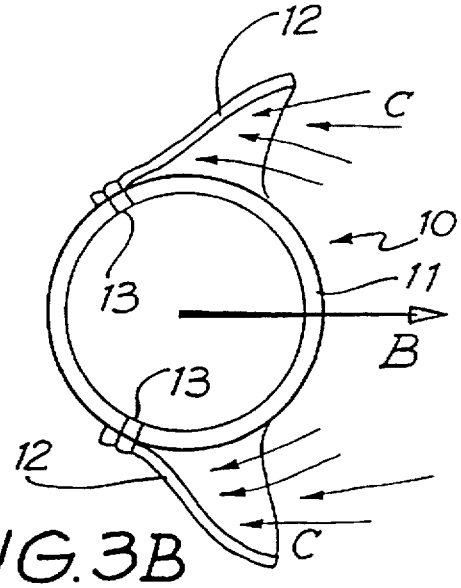
FIG. 3B is a schematic end elevational view of a paddling aid having the flaps open during movement in the opposite direction, and, FIG. 4 is a schematic perspective view of an outfolded swimming/paddling aid.

With reference to FIGS. 3A and 3B, the swimming aid 10 is shown moving in two directions A and B respectively.

Figure 1:
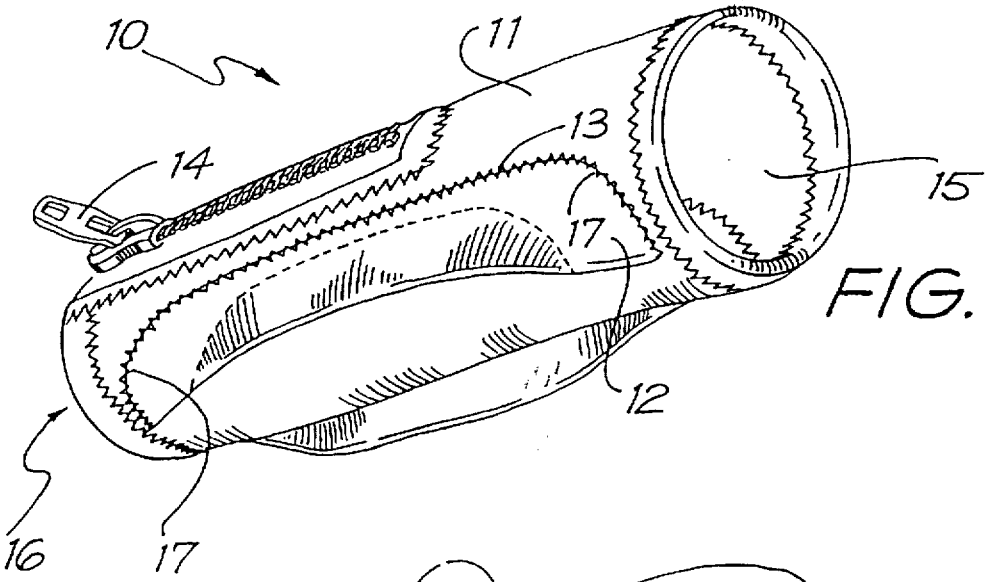
FIG. 1 is a schematic perspective view of a swimming or paddling
Figure 2A:
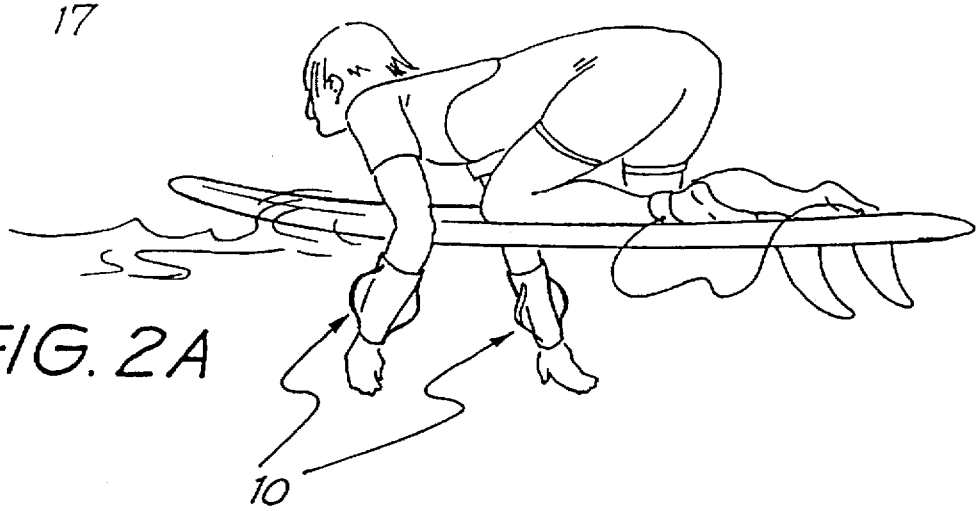
FIG. 2A is a schematic perspective view of a surfer wearing a pair of paddling aids as depicted in FIG. 1 about his forearms.

In FIG. 3B, the device 10 is shown moving relative to the water in a direction indicated by arrow B. Water flowing relative to device 10 in the opposite direction, indicated by arrows C causes each flap 12 to open thus providing a large projected area by which the swimmer propels him or herself through the water. Flaps 12 are prevented from opening beyond a predetermined position by the cup-shaped nature of the same. With reference again to FIG. 1, the cupping effect of flap 12 is provided by the curved end stitching zone 17.

With reference to FIG. 3A, the flaps 12 can be seen to close when the device 10 moves in the opposite direction indicated by arrow A. When moving in this direction, the water flows in the direction indicated by arrows D to close flaps 12 and thus minimising the resistance of the device to the flow of water therepast.

Figure 4:
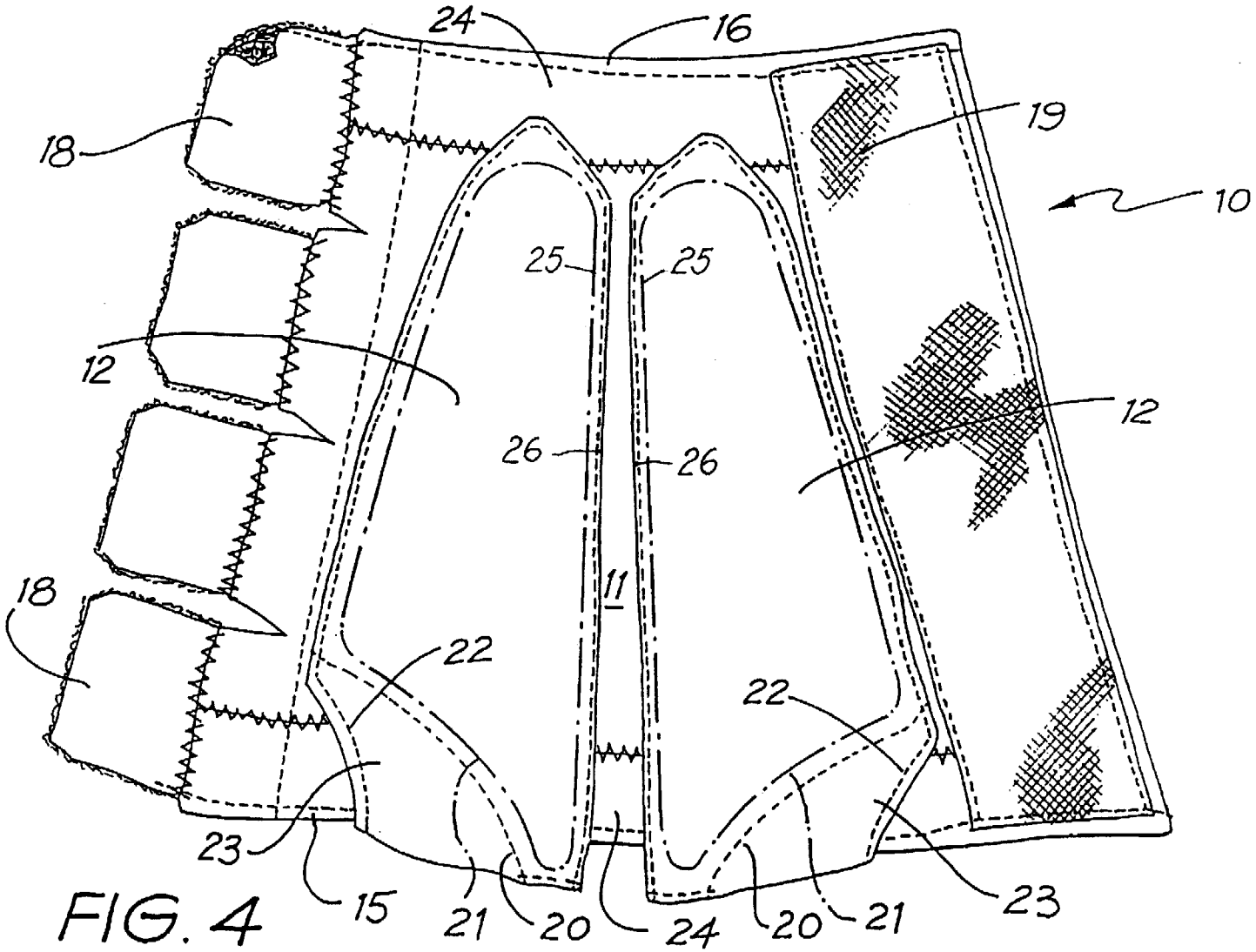

With reference to FIG. 4, an alternative embodiment of swimming/paddling aid 10 is depicted. In this embodiment, rather than the provision of a zipper 14, hook and loop type fasteners 18, 19 extend between the ends which when folded about a user's forearm form openings 15 and 16. Reinforcing bands 24 are provided about each end 15, 16. Bands 24 might simply be a double layered section of cover 11. Alternatively, a relatively inextensible insert may be provided in each band.

In this particular embodiment, each of the flaps 12, being double layered encase a comparitively rigid insert 21, typically cut from a thin sheet of plastics material. Each insert 21 comprises a continuous outer edge 25 positioned alongside an outer edge 26 of flap 12. The material from which flaps 12 are made, is preferably to be substantially inextensible, whilst being flexible. For example, nylon sheet material is suitable. However, any other material which is capable of retaining a cup formation in flaps 12 under in-use load conditions will suffice. A line of stitching 20 follows the profile of the lower edge of plastics insert 21. Spanning between the stitch line 20 and the line of stitching 22 attaching the flap 12 to cover 11 is a zone 23 of flap 12 having no insert therein. This zone 23 aids in allowing the flap 12 to open out in use into a cup-shaped formation. The zone 23 of substantially inextensible material is to be connected to the band 15 which is also relatively inextensible as compared to the material generally used in cover 11. That is, the flaps 12 are "anchored" at the line of stitching 22 to the relatively inextensible band 15. Such assists in ensuring that a cup formation is retained under in-use load conditions. Similar anchoring is typically provided at the other end of the cover 11.

It should be appreciated that modifications and alterations obvious to those skilled in the art are not to be considered as beyond the scope of the present invention. For example, the device may be an integrally moulded rubber sleeve. Alternatively, the flaps 12 may be secured to cover 11 by hinge means or adhesive means.

I claim:

1. A device for wearing by a swimmer, surfer, or other person to aid in paddling through or upon water, said device comprising:

a flexible cover to be worn about a limb of a person, at least one flexible flap extending outwardly from said flexible cover and adapted to open upon movement of the person's limb substantially in a first predetermined direction through the water, and to essentially close upon movement in a direction substantially opposite to said first mentioned direction, and an insert located in each flap, each insert comprising a thin sheet of material having a continuous outer edge positioned alongside an outer edge of the flap.

2. The device of claim 1 comprising two flaps, each at mutually opposed lateral locations of the flexible cover.

3. The device of claim 1 wherein each flap is attached to the flexible cover to form a cup-shape therewith.

4. The device of claim 1 wherein the flaps are stitched to the flexible cover.

5. The device of claim 1 wherein the flexible cover has an opening at one end which is substantially smaller than an opening at the other end.

6. The device of claim 5 wherein the cover comprises a zipper or other fastening means extending from the end having the smaller opening, toward the other end.

7. The device of claim 6 wherein the zipper or other fastening means reaches the other end.

8. The device of claim 1 wherein the cover is formed of elastic material such as neoprene.

9. The device of claim 1 wherein the flap(s) is/are formed from a substantially inextensible, though flexible material.

10. The device of claim 9 wherein the flaps are formed from nylon sheeting.

11. The device of claim 5 further comprising a pair of substantially inextensible bands, each located about the openings at said one and other ends.

12. The device of claim 1 wherein the cover forms part of the sleeve of a wet suit.

13. The device of claim 1 wherein each flap further comprises a zone having no insert therein, the zone being formed of substantially inextensible material.

14. The device of claim 11 wherein said bands are integral to the flexible cover.

15. A device for wearing by a swimmer, surfer, or other person to aid in paddling through or upon water, said device comprising:

a flexible cover to be worn about a limb of the person at least one flexible flap extending outwardly from said flexible cover and adapted to open upon movement of the person's limb substantially in a first predetermined direction through the water, and to essentially close upon movement in a direction substantially opposite to said first mentioned direction and an insert located in each flap, each insert being formed from a thin sheet of material and having a periphery defining an area corresponding with a substantial area of said flap, wherein each flap further comprises a zone having no insert therein, the zone being formed of substantially inextensible material.

* * * * *